United States Patent [19]

Yoke

[11] Patent Number: 4,934,659

[45] Date of Patent: Jun. 19, 1990

[54] HOIST AND DOLLY APPARATUS

[76] Inventor: James H. Yoke, Rte. 15, Box 395, Acton, Ind. 46259

[21] Appl. No.: 322,167

[22] Filed: Mar. 13, 1989

[51] Int. Cl.[5] ..... B66D 3/00; B66D 5/12

[52] U.S. Cl. ..... 254/326; 254/4 R; 254/375

[58] Field of Search ..... 254/4 R, 4 C, 4 B, 323, 254/325, 326, 327, 375; 212/188, 187, 265, 266

[56] References Cited

U.S. PATENT DOCUMENTS

| | | | |
|---|---|---|---|
| 1,021,585 | 3/1912 | Ewert . | |
| 1,380,779 | 6/1921 | Craig . | |
| 1,599,106 | 9/1926 | Weathers | 254/4 B |
| 1,974,463 | 9/1934 | Kintzley | 254/325 |
| 2,305,202 | 12/1942 | Smith | 212/187 |
| 2,634,875 | 4/1953 | Trautner . | |
| 2,675,209 | 4/1954 | Freed | 212/187 |
| 2,804,979 | 9/1957 | Lassiter | 212/265 |
| 3,450,386 | 6/1969 | Eliel | 254/326 |
| 3,603,171 | 9/1971 | Dodge . | |
| 4,008,881 | 2/1977 | Ross . | |
| 4,190,233 | 2/1980 | Godfrey . | |
| 4,199,133 | 4/1980 | Gagnon . | |
| 4,531,715 | 7/1985 | Wiens . | |

*Primary Examiner*—Katherine A. Matecki

*Attorney, Agent, or Firm*—Woodard, Emhardt, Naughton, Moriarty & McNett

[57] ABSTRACT

A hoist and dolly apparatus includes a pair of vertical columns mounted with angle braces to a horizontal base supported by wheels. A boom has a proximal end pivotally connected to cross braces extending between the vertical columns, and a distal end carrying a pulley. A cable reel is rotatably mounted between the vertical columns, and a cable extends from the reel to and over the pulley at the distal end of the boom. A crank handle is connected through a crank shaft to the crank reel. A cable reel brake is provided for securing the cable reel in a selected position, and a cable brake release provides for controlled releasing of the brake to permit taking up and feeding out of cable from the cable reel.

10 Claims, 5 Drawing Sheets

HOIST AND DOLLY APPARATUS

BACKGROUND OF THE INVENTION

1. Field of the Invention:

The present invention relates to the field of portable hoists and carrying devices, and particularly to a combination unit.

2. Description of the Prior Art:

A variety of devices have been provided in the prior art for lifting and transporting cargo. Many of these devices have included a lower platform supported on wheels, a vertical support structure, and a boom having a cable hoist associated therewith. Some of these devices, however, have fairly complicated structures which make them relatively cumbersome and expensive, and not readily collapsed for storage.

In U.S. Pat. No. 4,190,233 issued to Godfrey on Feb. 26, 1980, there is described a jack of this general type. The Godfrey jack includes a frame supported on wheels and having an elaborate vertical support mounted thereto. The vertical support includes a first, primary post mounted to the horizontal frame with multiple braces. A second vertical post is also mounted to the frame, and is secured at the top end to the first post. A boom is attached to the top end of the first post, and a brace is slidably supported on the second post and supports the boom. A jack is mounted to the frame on the end opposite the primary post, and a motorized winch is mounted to the top end of the first post and includes a cable extending along the boom and over a pulley thereon.

A portable crane is described in U.S. Pat. No. 1,380,779 issued to Craig on June 7, 1921. The crane includes a lower frame comprising a pair of horizontally extending legs secured together at one end and being supported by wheels at both the secured and the free ends. A vertical post extends upwardly from a cross-member connecting the legs intermediate their ends. A boom extends at an upward angle from the middle of the post, and is supported by a pair of rods extending from the free end of the boom to the top end of the post. A winch is secured to the lower end of braces connecting between the support legs and the vertical post, and a chain extends from the winch over a pulley mounted to the top end of the post and over a second pulley mounted at the free end of the boom.

A portable hoist is described in U.S. Pat. No. 2,634,875 issued to Trautner on Apr. 14, 1953, which includes a horizontal bottom frame mounted on wheels, and carrying a pair of telescoping posts extending upwardly therefrom. A winch is mounted to the lower, outer post secured with the frame, and includes a cable which connects with the lower end of the inner telescoping post to be operable to raise and lower the inner post relative the outer post.

A stationary hoisting apparatus is described in U.S. Pat. No. 1,021,585 issued to Ewert on Mar. 26, 1912. The Ewert device includes a post secured in the ground and having a boom pivotally mounted to its upper end and supported by a cross brace extending between the post and the boom. A winch is mounted on the lower half of the vertical post and includes a cable which runs to a pulley secured to the free end of the boom.

A variety of winch assemblies are known in the prior art. Examples of such devices are shown in U.S. Pat. Nos. 3,603,171 issued to Dodge on Sept. 7, 1971; 4,008,881 issued to Ross on Feb. 22, 1977; 4,199,133 issued to Gagnon, et al. on Apr. 22, 1980; and 4,531,715 issued to Weins on July 30, 1985.

SUMMARY OF THE INVENTION

Briefly describing one aspect of the present invention, there is provided a hoist and dolly apparatus which includes a horizontal base, wheel means for supporting the base, a pair of spaced, upstanding vertical columns having cross-bars connecting therebetween, a boom pivotally connected at one end to the vertical columns, a brace pivotally connected with the vertical columns and the boom, a cable reel rotatably mounted to the top of the vertical columns and a crank attached to the crank reel, a pulley at the distal end of the boom, a cable secured to the cable reel and extending over the boom pulley, a cable reel brake and a cable brake release.

It is an object of the present invention to provide a hoist and dolly apparatus which is of simple and durable construction, and is easy to use.

Another object of the present invention is to provide an apparatus which may be collapsed for storage purposes.

Further objects and advantages of the present invention will become apparent from the description of the preferred embodiment which follows.

DESCRIPTION OF THE PREFERRED EMBODIMENT

Figure 1:
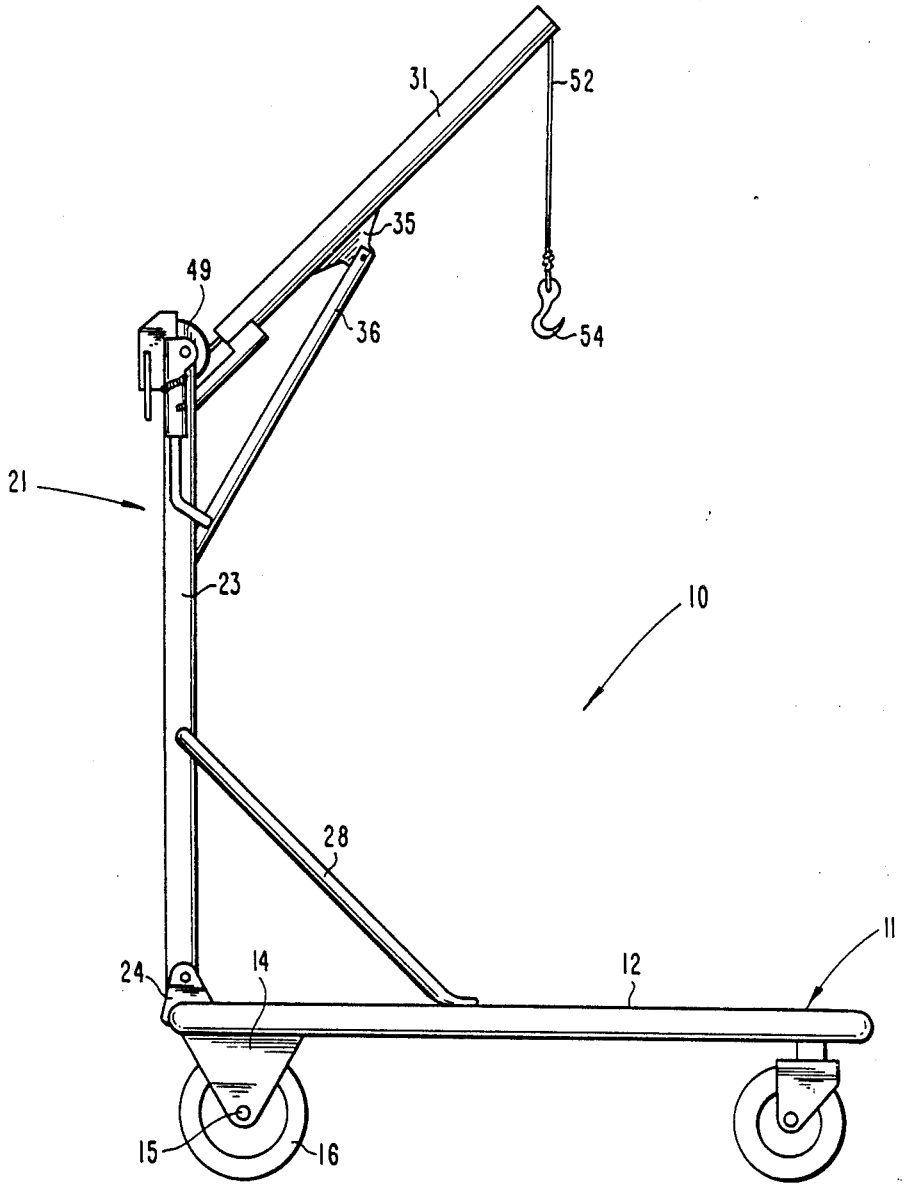
FIG. 1 is a side, elevational view of a hoist and dolly apparatus constructed in accordance with the present invention.
Figure 2:
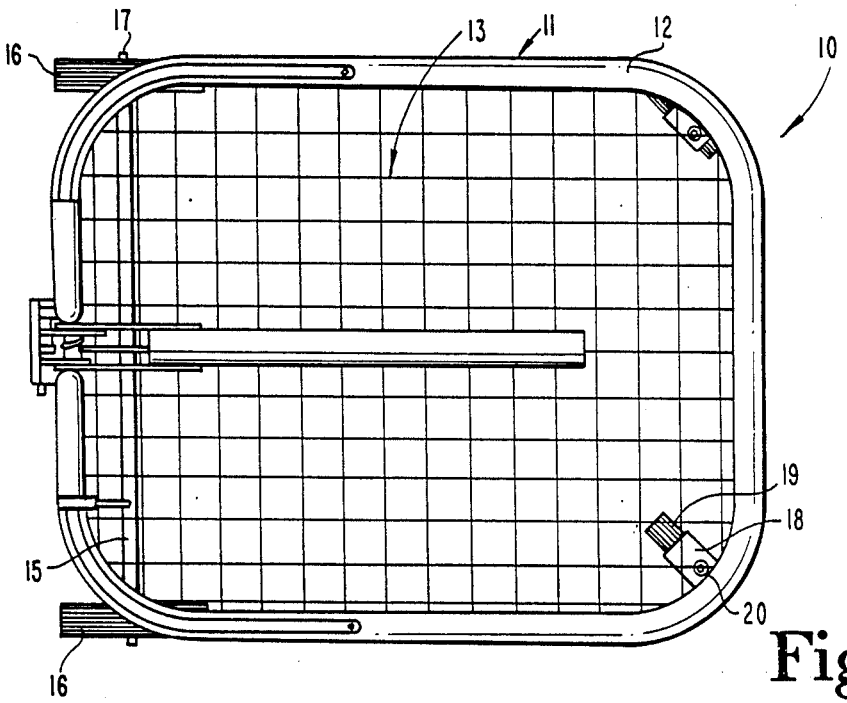
FIG. 2 is a top, plan view of the apparatus of FIG. 1.
Figure 3:
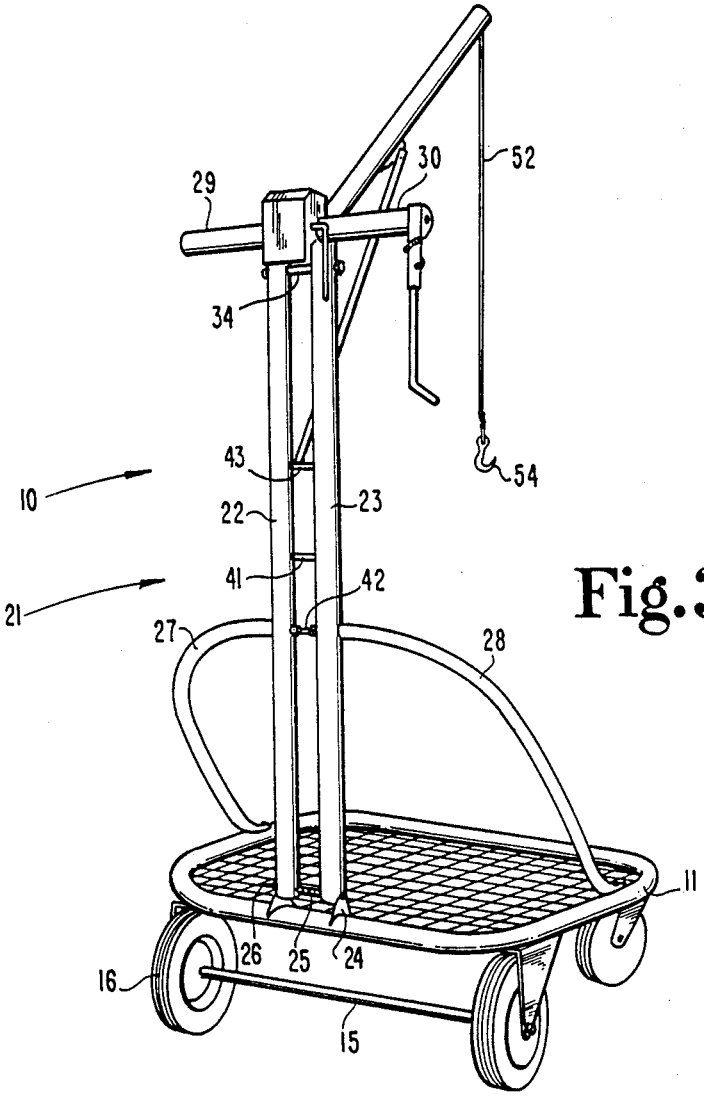
FIG. 3 is a rear, perspective view of the apparatus of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to the drawings, there is shown a hoist and dolly apparatus 10 constructed in accordance with the present invention. The apparatus 10 includes a horizontal base 11 including a rectangular frame 12 of perimetric tubular members. A support surface 13 spans within the frame 12, and may preferably comprise a wire mesh which gives adequate strength without adding unnecessary weight.

Wheel means are provided on the apparatus for supporting the base 11 on a surface. The wheel means may include, for example, two pairs of wheels located at the corners of the rectangular frame 12. Wheel brackets 14 are welded to the frame 12, and are provided with apertures within which a through axle 15 is received. A pair of wheels 16 are received over the axle 15 and retained thereon by push-on nuts 17. A pair of cylindrical caster brackets 18 are welded at the front corners of the frame 12, and caster wheels 19 are mounted in conventional fashion to the brackets 18 by means of a shaft 20 received within the cylindrical bracket.

A vertical support 21 is mounted to the base 11, and includes a pair of spaced, upstanding vertical columns 22 and 23. A pair of column brackets 24 are welded to the frame 12. A threaded rod 25 is received through aligned apertures in the columns 22 and 23 and the column brackets 24, and four hex nuts 26 are received on the rod 25 to secure the vertical columns to respective brackets. A pair of arcuate column braces 27 and 28 are secured between the frame 12 and respective vertical columns 22 and 23, and may be secured by various means such as bolting or welding. The braces are preferably secured by means of bolts, thus permitting the apparatus 10 to be readily collapsed into a compact arrangement by simply loosening and/or removing appropriate bolts connecting the cross braces 27 and 28 and pivoting the vertical columns 22 and 23 down against the base 11. The upper end of the two vertical columns 22 and 23 include horizontal handle members 29 and 30, respectively.

A boom 31 is pivotally mounted to the top of the vertical support 21. Boom 31 (FIGS. 4 and 5) comprises a tubular member secured by welding to a channel-shaped boom bracket 32. The boom bracket includes a pair of apertures 33 through which is received a rod 34 extending through holes in the columns 22 and 23, and welded thereto. The boom thereby is attached to the vertical support 21 for pivoting about the horizontal axis of the rod 34.

Figure 6:
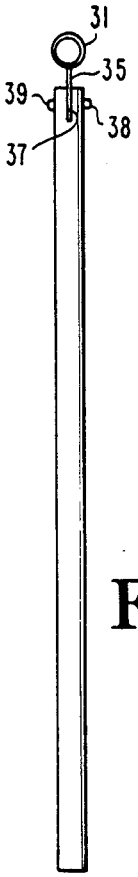
FIGS. 6 and 7 are top and side views of a boom brace useful with the present invention, and shown with its attachment to the boom of FIGS. 4 and 5.
Figure 7:
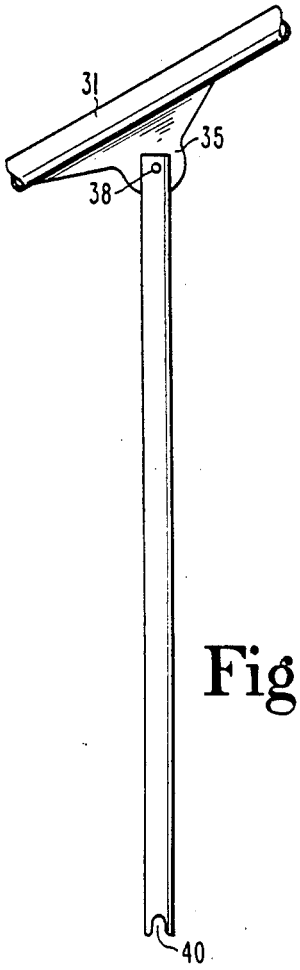

A bracket 35 is welded to the underside of the boom 31. A boom brace 36 (FIGS. 6 and 7) is secured between the boom 31 and the vertical support 21. At the upper end, the boom brace 36 includes a slot 37 within which the bracket 35 is received. A round head pin 38 is received through aligned apertures in the boom brace 36 and bracket 35, and a push nut 39 is secured to the other end of the pin.

Figure 4:
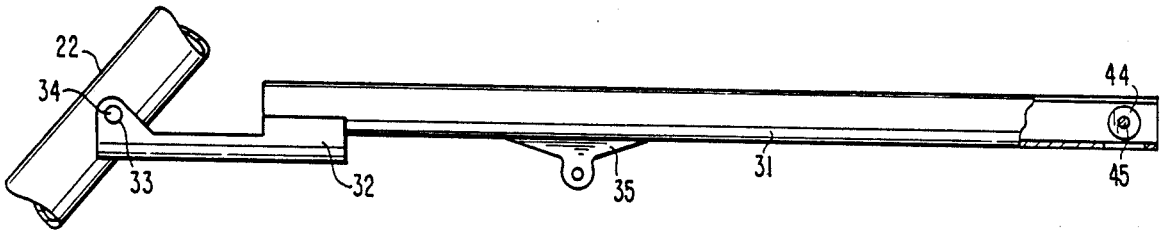
FIGS. 4 and 5 are side and top views of a boom useful with the present invention.
Figure 5:
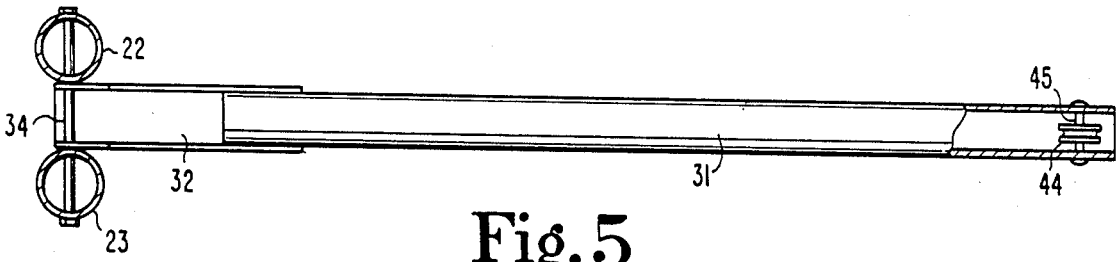

At the lower end, the boom brace 36 includes a second slot 40. A plurality of cross-bars 41–43 extend between the vertical columns 22 and 23. These cross-bars may comprise for example, a rod extending through aligned apertures in the vertical columns 22 and 23, and welded at the outside surfaces of the columns. The slot 40 of boom brace 36 is receivable over each of the different cross-bars 41–43, thus providing an adjustable support position for the boom 31. Also as shown in FIGS. 4 and 5, the boom 31 includes a pulley 44 suspended within the hollow boom by means of a rod 45 extending through aligned apertures in the boom and secured to the exterior by welding or the like.

Figure 8:
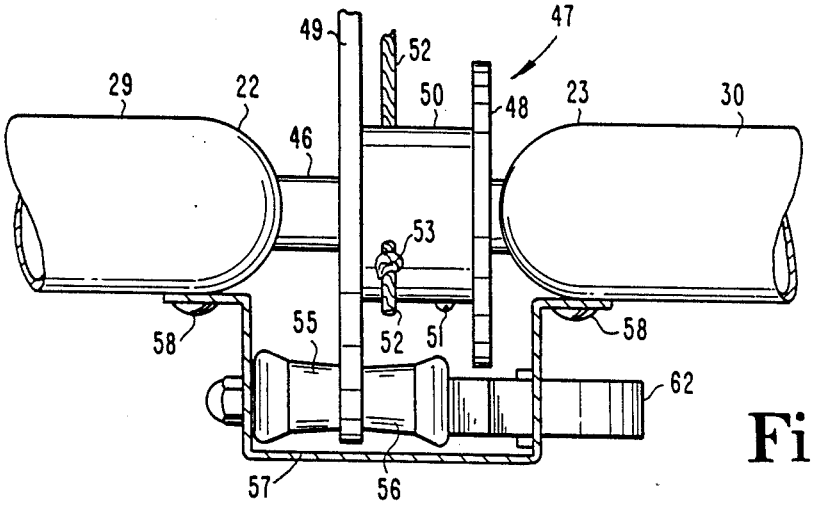
FIG. 8 is a top, plan view showing the brake assembly of the preferred embodiment of the present invention.
Figure 9:
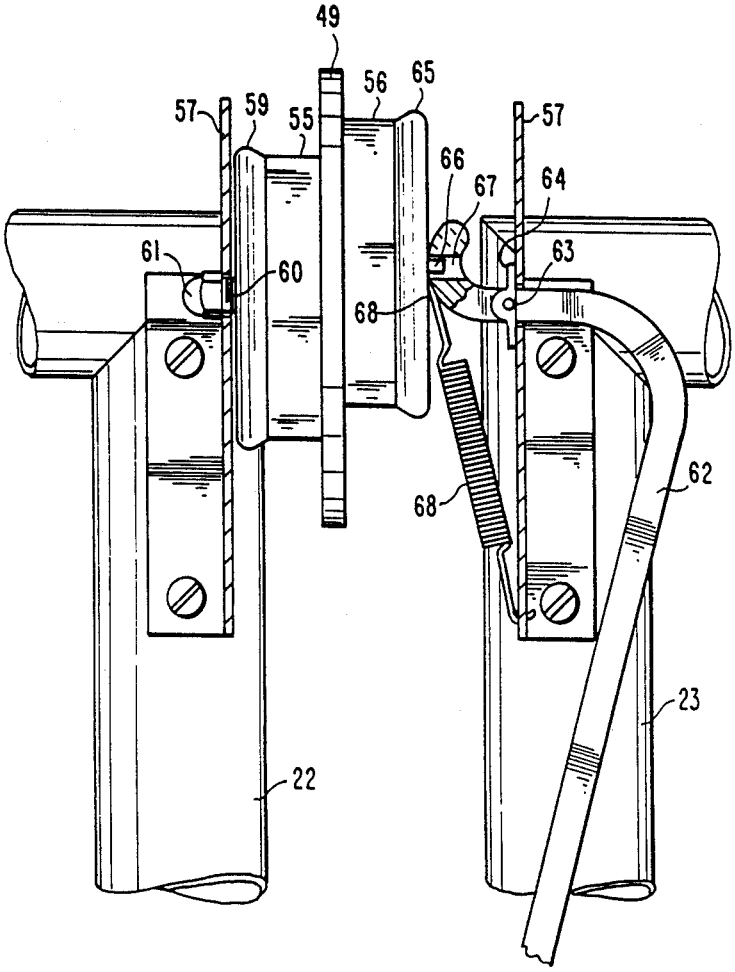
FIG. 9 is a front, elevational view of the brake assembly of FIG. 8.
Figure 10:
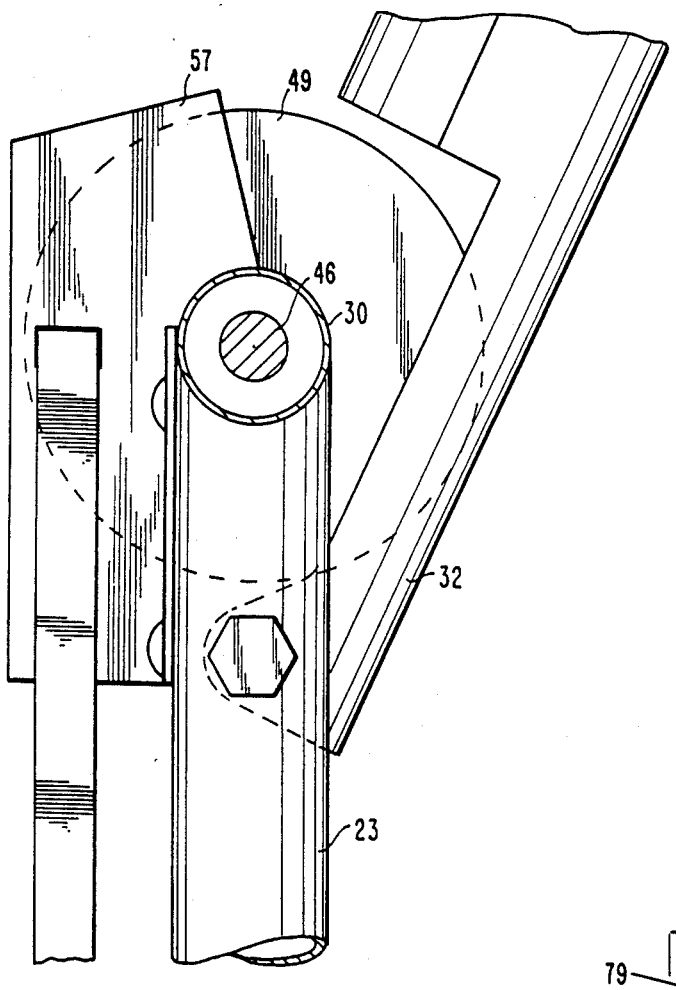
FIG. 10 is a side, elevational view of the brake assembly of FIG. 8.

Referring in particular to FIGS. 8–10, the mounting of the cable reel and associated brake is shown. A shaft 46 extends through aligned apertures in the vertical columns 22 and 23, and particularly through the handle members 29 and 30. Bearings (not shown) may be included within the handle members to facilitate rotation of the shaft 46. The cable reel 47 includes an idler disk 48, brake disk 49 and connecting cylinder 50 secured together. Cylinder 50 is secured to the shaft 46 by means of a set screw 51. A cable 52 is received upon cylinder 50 between the idler disk 48 and brake disk 49 and is attached to the cylinder by suitable means, such as by receipt through an aperture 53. Cable 52 extends through boom 31 and over pulley 44, extending downwardly therefrom and terminating preferably in a connection with a hook 54 (FIG. 1).

A pair of brake pads 55 and 56 are mounted in position to bear against the brake disk 49 to prevent rotation of the cable reel 47. A brake housing 57 is secured to vertical columns 22 and 23 by screws 58. Brake pad 55 includes a pad holder 59 including a threaded rod 60 extending therefrom. Brake pad 55 and holder 59 are secured to the housing 57 by nut 61 received upon the threaded rod 60. Brake lever 62 includes an aperture within which is received a pin 63. A pair of brackets 64 are secured to the interior of the brake housing 57 on either side of the brake lever 62, and receive pin 63 to permit pivoting movement of the brake lever 62 about the longitudinal axis of the pin 63. Brake pad 56 is mounted to holder 65 which includes an outwardly extending rod 66 which is in turn received within an aperture 67 defined by brake lever 62.

Brake lever 62 is provided with an arcuate surface 68 contoured to provide movement of pad 56 toward brake disk 49 when the lever 62 is rotated counter-clockwise in FIG. 9. Such movement of the brake lever forces the brake pad 56 against the brake disk 49, and firmly holds the disks between the two pads 55 and 56. A tension spring 68 connects between the brake lever and brake housing to bias the lever in the counter-clockwise direction, firmly engaging the brake pads 55 and 56 against the brake disk 49. The braking system is therefore normally maintained in the braked or locked position as shown in FIG. 9. In operation, the brake lever may be moved in the counter-clockwise direction in FIG. 9, against the resistance of spring 68, thus reducing the pressure of pads 55 and 56 against brake disk 49, and permitting rotation of the cable reel 47. It will also be appreciated that rotation of the cable reel in the take-up direction clockwise in FIG. 10 tends to move brake pad 56 in the upward direction in FIG. 9, thus urging the brake lever in the clockwise direction and releasing the brake pressure to permit such movement of the cable reel. Thus, the brake is at least partially released when the cable 52 is being taken up, and separate release of the brake may not be necessary.

Figure 11:
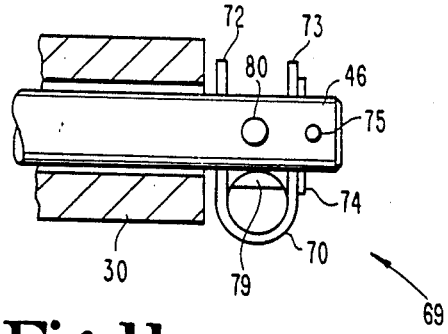
FIG. 11 is a partial, cross-sectional view showing particularly the crankshaft and attached crank.
Figure 12:
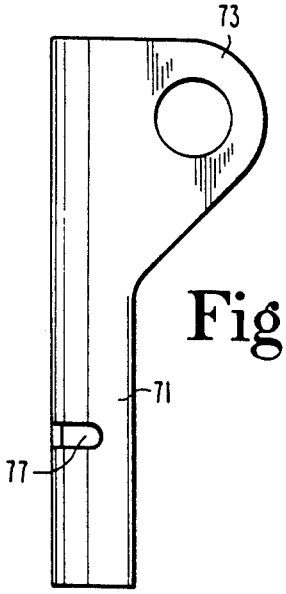
FIG. 12 is a side, elevational view of the crank housing used with the present invention.
Figure 13:
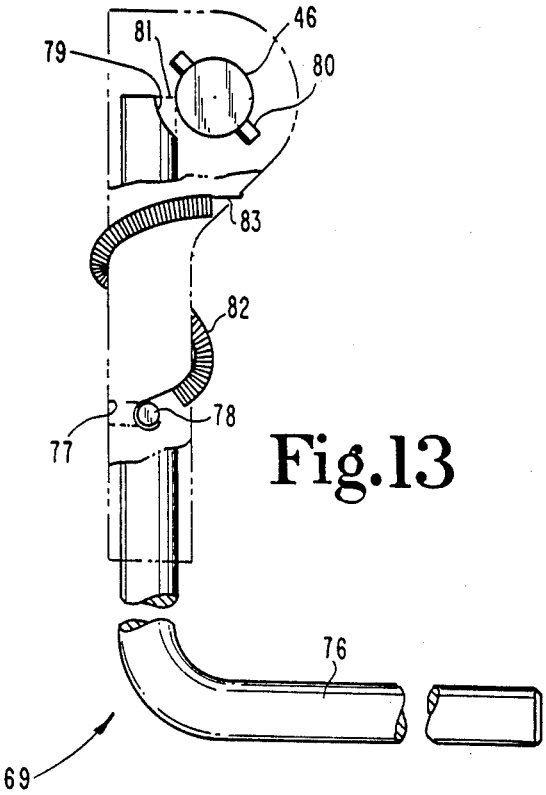
FIG. 13 is a side, elevational view showing the crank used in the preferred embodiment in the present invention, and particularly its attachment to the crank housing and shaft.

Referring in particular to FIGS. 11–13, there is shown a crank assembly useful in accordance with the present invention. Crank assembly 69 includes a crank housing 70 (FIG. 12) having a cylindrical body portion 71 and a pair of ears 72 and 73 defining aligned apertures within which the shaft 46 is received. Crank housing 70 is retained on the shaft 46 by means of a washer 75 and a cotter pin 76 received through a hole at the end of the shaft 46. The crank housing is thereby maintained in position adjacent the outer edge of the handle member 30 (FIG. 11).

A crank 76 is received within the cylindrical body portion 71 of the crank housing 70. The housing defines a partial, radial slot 77, and a pin 78 extending from an aperture in the crank 76 is received within the slot 77. Reception of the pin 78 within the slot 77 retains the crank within housing 70 and permits limited rotational movement of the crank. Crank 76 includes a cylindrical upper end, and is provided with an arcuate recess 79 (FIG. 13). A catch pin is force fit within an aperture in the shaft 46 and extends outwardly from both surfaces of the shaft. The extension of the pin is sized such that the recess 79 permits free rotation of the shaft 46 when the crank is in the disengaged position, as shown in FIG. 13. However, upon rotation of the crank, in the direction clockwise in FIG. 11, the full diametric width of the upper portion of the crank, shown at 81 in dashed lines in FIG. 13, is presented to engage the catch pin 80. Thus, in the non-rotated position, the shaft 46 may move freely, with the pin 80 clearing the crank 76 due to the location of the recess 79. In the rotated position, the crank will engage pin 80 and turning the crank will result in rotation of shaft 46, and consequent operation of the cable reel 47.

In operation, the hoist and dolly apparatus 10 is useful for lifting and lowering materials by mean of the hook 54 and cable 52, and associated cable reel 47. When the crank is in the rotated position, the shaft is engaged and rotation of the crank in the clockwise direction in FIG. 13 will cause the cable reel 47 to rotate, taking up the cable 52 and lifting the hook 54. The spring 68 biases the brake lever 62 in the braking position, thus holding the cable reel from movement when the crank is not operated. As previously indicated, the orientation of the brake lever 62 is such that the braking action is released simply by operation of the crank, but it is automatically applied when the crank is released. In the non-rotated position, the crank is positioned such that the shaft 46 may rotate without interference with the crank 76. The crank assembly is provided with a tension spring 82 attached at one end to the pin 78 and wrapping around the crank housing and being secured thereto at a second location 83. Spring 82 biases the crank 76 in the unrotated position. In this position, the shaft 46 rotates freely and the crank is therefore prevented from rotating when in this position. This is useful, for example, when a carried object is desired to be lowered. This may be accomplished by releasing the brake lever, and the crank will then remain in a stationary position which is desired While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A hoist and dolly apparatus which comprises:

a horizontal base including a rectangular frame of perimetric tubular members and a support surface spanning within the frame;

wheel means for supporting said base on a surface;

a vertical support including a pair of spaced, upstanding vertical columns and cross-bars connecting between the vertical columns;

a pair of handles extending outwardly from both sides of said vertical support and secured thereto, at least one of said handles being hollow;

a boom having a proximal end pivotally connected to the top of said vertical support and having a free distal end;

a brace having a proximal end pivotally connected with said vertical support and a distal end pivotally connected to said boom, the proximal end including a slot within which one of the cross-bars is received;

a cable reel rotatably mounted to the top of said vertical support between the vertical columns;

crank means connected with said cable reel for rotation of said cable reel, said crank means including a crank shaft attached to said crank reel and a crank arm attached to the shaft, the crank shaft extending through said hollow handle, the crank arm being attached to the shaft externally of said hollow handle;

a pulley mounted to the distal end of said boom;

a cable secured to said cable reel and extending over said boom pulley;

cable reel brake means for securing said cable reel in a selected position to avoid feeding out of cable; and, a cable brake release means for controllably releasing said brake means to permit rotation of said crank reel for taking up or feeding out said cable from said cable reel.

2. The apparatus of claim 1 in which the support surface of said horizontal base comprises a wire mesh extending between the perimetric tubular members.

3. The apparatus of claim 1 in which said crank arm is releasably secured to said crank shaft and which further includes means for releasably securing said crank arm to said crank shaft, said securing means having a first condition in which said crank arm is fixed relative said crank shaft for permitting rotation of said crank shaft by movement of said crank arm and a second condition in which said crank arm is released from securement relative said crank shaft for permitting rotation of said crank shaft without corresponding movement of said crank arm.

4. The apparatus of claim 3 in which said securing means comprises said crank arm and crank shaft having corresponding engagement surfaces and said crank arm being moveable between a first position in which the surfaces are engaged and a second position in which the surfaces are not engaged.

5. The apparatus of claim 4 and which includes biasing means for biasing said crank arm in the second position.

6. The apparatus of claim 5 in which said crank arm is rotatable between the first and second positions.

7. A hoist and dolly apparatus which comprises:

a horizontal base including a rectangular frame of perimetric tubular members and a support surface spanning within the frame;

wheel means for supporting said base on a surface;

a vertical support including a pair of spaced, upstanding vertical columns and cross-bars connecting between the vertical columns;

a boom having a proximal end pivotally connected to the top of said vertical support and having a free distal end;

a brace having a proximal end pivotally connected with said vertical support and a distal end pivotally connected to said boom, the proximal end including a slot within which one of the cross-bars is received;

a cable reel rotatably mounted to the top of said vertical support between the vertical columns;

crank means connected with said cable reel for rotation of said cable reel, said crank means including a crank shaft attached to said crank reel and a crank arm attached to the shaft;

a pulley mounted to the distal end of said boom;

a cable secured to said cable reel and extending over said boom pulley, said cable being attached to said cable reel to have the cable to extended when said cable reel is turned in a first rotational direction and to have the cable be retracted when said cable reel is turned in a second, opposite rotational direction;

cable reel brake means for securing said cable reel in a selected position to avoid feeding out of cable, said cable reel brake means including a brake disk fixed to said cable reel, said cable reel brake means further including a bearing means having a brake shoe for bearing against the brake disk to limit rotation of said cable reel, said bearing being means for automatically applying sufficient pressure of the brake shoe against the brake disk to normally prevent rotation of said cable reel in the first rotational direction, said bearing means further being for releasing pressure of the brake shoe against the brake disk upon turning of said cable reel in the second rotational direction; and, a cable brake release means for selectively releasing pressure of the brake shoe against the brake disk to permit rotation of said crank reel in the first rotational direction for feeding out said cable from said cable reel.

8. The apparatus of claim 7 in which the support surface of said horizontal base comprises a wire mesh extending between the perimetric tubular members.

9. The apparatus of claim 7 and which further includes a pair of handles extending outwardly from both sides of said vertical support and secured thereto.

10. The apparatus of claim 9 in which at least one of said handles is hollow, the crank shaft extending through said hollow handle, the crank arm attached to the shaft externally of said handle.

* * * * *